United States Patent [19]

Wieland

[11] Patent Number: 4,730,557

[45] Date of Patent: Mar. 15, 1988

[54] PRINTING PLATE CLAMPING ASSEMBLY

[75] Inventor: Erich G. Wieland, Würzburg, Fed. Rep. of Germany

[73] Assignee: Koenig & Bauer Aktiengesellschaft, Fed. Rep. of Germany

[21] Appl. No.: 77,878

[22] Filed: Jul. 27, 1987

[30] Foreign Application Priority Data

Aug. 8, 1986 [DE] Fed. Rep. of Germany ..... 3626936

[51] Int. Cl.[4] ..... B41F 27/12

[52] U.S. Cl. ..... 101/415.1; 101/378

[58] Field of Search ..... 101/378, 415.1

[56] References Cited

U.S. PATENT DOCUMENTS

| | | | |
|---|---|---|---|
| 3,605,621 | 9/1971 | Woessner et al. | 101/415.1 |
| 4,359,941 | 11/1982 | Fels | 101/415.1 |
| 4,527,478 | 7/1985 | Difflipp et al. | 101/415.1 |

FOREIGN PATENT DOCUMENTS

| | | | |
|---|---|---|---|
| 7932632 | 2/1980 | Fed. Rep. of Germany . | |
| 3226119 | 4/1983 | Fed. Rep. of Germany | 101/415.1 |
| 2151213 | 7/1985 | United Kingdom | 101/415.1 |

*Primary Examiner*—Edgar S. Burr
*Assistant Examiner*—Joseph McCarthy
*Attorney, Agent, or Firm*—Jones, Tullar & Cooper

[57] ABSTRACT

A printing plate clamping assembly is situated within a housing carried in a groove at the periphery of a plate cylinder. An adjusting shaft is supported for both rotation and translation by a plurality of spaced roller rings. A bearing support is carried by the adjusting shaft and receives a first end of a connecting link. A second end of this connecting link is received in a first end of a first lever arm of a clamping bar which has a clamping flap at a free end of a second lever arm. Movement of adjusting shaft in both a rotational and transitional manner effects proper printing plate end clamping over a wide range of plate thicknesses.

4 Claims, 1 Drawing Figure

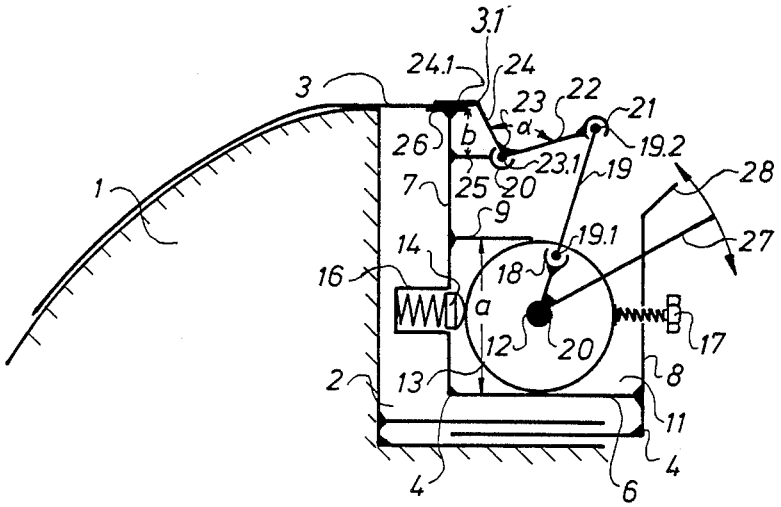
3.1
24.1
24
3
23
22
21
26
b
α
19.2
23.1
19
28
1
7
25
20
9
19.1
27
14
18
16
a
12
20
17
2
13
8
11
4
4
6

PRINTING PLATE CLAMPING ASSEMBLY

FIELD OF THE INVENTION

The present invention is directed generally to a printing plate clamping assembly. More particularly, the present invention is directed to a printing plate clamping assembly having a clamping bar actuated by a knuckle joint. Most specifically, the present invention is directed to a printing plate clamping assembly having a clamping bar actuated by a knuckle joint which is operable by a translationally shiftable adjustment shaft. This adjustment shaft is supported by spaced roller rings that are shiftable within a slot formed in the outer surface of the printing plate support cylinder. A series of cooperating spring biased tappets and adjustment screws are used to allow the position of the adjustment shaft to shift in the plate cylinder groove during clamping and unclamping of the plate cylinder particularly in compensation for thickness variations in printing plates being clamped.

DESCRIPTION OF THE PRIOR ART

Plate clamping assemblies, in which one end of a printing plate is clamped between a base plate secured to a plate cylinder and a moveable clamping flap, are generally known in the art. German utility model No. 79 32 632 shows such a printing plate clamping assembly. In this device, the clamping flap is formed as a portion of a clamping lever which is pivotably supported about a first shaft that is secured to the cylinder. This clamping lever has a free lever arm which extends from this first shaft in a direction opposite to the clamping flap. The free lever arm is connected by an articulated joint to an end of a first connecting rod. This first connecting rod is, in turn, attached at its opposite end to an end of a second connecting rod that is rigidly connected to a rotatably supported shaft. An operating lever is used to rotate this rotatably supported shaft which in turn moves the clamping flap toward or away from the base plate.

Prior art plate clamping assemblies are not adaptable to clamping printing plates having varying thicknesses. Thus a compromise must be made so that the spacing between the base plate and the clamping flap will be selected so that it will be generally useable with most printing plates. However, such a size compromise inevitably results in a poor clamping performance for a variety of plate thicknesses. The resulting possibility of printing plate slippage has a detrimental effect on the quality of the printing produced by the printing press.

Prior art printing plate clamping devices generally of the type discussed above have often required the application of a substantial amount of force to effect plate clamping. The leverage afforded by prior art linkage systems has not been substantial and it has required a large amount of force to effect plate clamping using the prior art plate clamping devices. This large force requirement has effectively prevented the use of automatic clamping and unclamping means since these automatic means could not provide the necessary clamping device actuating force.

It will thus be seen that a need exists for a printing plate clamping assembly that is capable of being adjusted or is self-adjusted to accommodate for plates of varying thicknesses and further which does not require particularly large clamping forces. The printing plate clamping assembly of the present invention provides such a device.

SUMMARY OF THE INVENTION

It is an object of the present invention to provide a printing plate clamping assembly.

A further object of the present invention is to provide a plate clamping assembly having a clamping bar.

Another object of the present invention is to provide a plate clamping assembly having a clamping bar actuated through a knuckle joint linkage.

Yet a further object of the present invention is to provide a printing plate clamping assembly having a clamping bar lockable in the clamped position.

Still another object of the present invention is to provide a printing plate clamping assembly that compensates for different sizes of printing plates to be clamped.

Even a further object of the present invention is to provide a printing plate clamping assembly which requires only a small clamping action to produce a strong clamping force.

As will be discussed in greater detail in the description of the preferred embodiment which is set forth subsequently, the printing plate clamping assembly in accordance with the present invention is carried in a groove formed at the periphery of the plate carrying cylinder and includes a clamping flap that holds an end of a printing plate against a clamping flap support surface. The clamping flap is formed at one end of a lever arm assembly which is supported intermediate its ends. A connecting rod extends between an end of this lever arm assembly and a bearing surface which is joined to an adjustment shaft. A plurality of spaced roller rings support the adjustment shaft and each of these roller rings is moveable within the groove at the surface of the printing plate. Clamping of a printing plate between the clamping flap and the clamping flap supporting surface is effected by rotating the adjustment shaft. Since this shaft can move in the groove due to either a sliding or a rolling action of the roller rings, the position of the adjustment or clamping shaft in the groove may be changed to compensate for varying plate thicknesses.

In contrast to the prior art devices, the printing plate clamping assembly in accordance with the present invention quickly and easily compensates for differing thicknesses in the printing plates being clamped. If the thickness of the plate increases from that of the previously clamped plate, the roller rings which support the clamping force applying shaft will slide or rotate in the groove as the clamping force is being applied to the printing plate being clamped. This changes the point of support of the connecting rod and thus effects the position at which over-center locking of this rod with respect to the lever arm assembly occurs. Thus the same clamping force can be provided by the clamping flap independent of the thickness of the printing plate.

The knuckle joint linkage system between the clamping flap and the adjustment shaft produces a large mechanical advantage. This allows clamping forces of a suitably large magnitude to be provided by a relatively small force, such as may be provided by servo units of low capacity. This allows automatic clamping and locking to be effective.

The printing plate clamping assembly in accordance with the present invention provides a suitable printing plate clamping force for various printing plates that are of differing thicknesses. It does so while requiring only a small amount of force so as to be capable of automatic operation. As such, it provides a substantial improvement over prior art devices.

BRIEF DESCRIPTION OF THE DRAWING

While the novel features of the printing plate clamping assembly in accordance with the present invention are set forth with particularity in the appended claims, a full and complete understanding of the invention may be had by referring to the detailed description of the preferred embodiment, as is set forth subsequently, and as illustrated in the accompanying sole drawing FIGURE which is a schematic side elevation view of a printing plate clamping assembly in accordance with the present invention.

DESCRIPTION OF THE PREFERRED EMBODIMENT

Referring now to the sole drawing FIGURE, there may be seen generally at 1 a plate cylinder which is equipped with the printing plate clamping assembly in accordance with the present invention. Plate cylinder 1 is provided with an axially extending slot or groove 2 adjacent its periphery and it is within this slot or groove 2 that the printing plate clamping assembly is situated. This assembly is used to clamp an end 3.1 of a printing plate 3 which is to be secured to the plate cylinder 1 for rotation therewith. While not specifically discussed, it will be understood that plate cylinder 1 and printing plate 3 are generally well known in structure and function and form a part of a larger printing assembly that is not shown and need not be discussed in detail.

A housing, generally at 4 is positioned within the plate cylinder groove 2 and extends axially the full length of groove 2. Housing 4 includes a generally flat base plate 6 which is generally parallel to the interior floor of groove 2; a pair of spaced, generally vertical side walls 7 and 8 which are welded or otherwise positively secured at first ends to base plate 6; and a generally horizontal upper wall plate 9 which projects into groove 2 from its point of weldment or other secure attachment to side wall 7. Upper wall plate 9 extends into groove 2 at a height "a", as will be discussed subsequently, above base plate 6. Upper end wall plate 9 has a width that is approximately one half the width of horizontal base plate 6.

Horizontal base wall 6, spaced side walls 7 and 8, and upper end wall 9 serve to define a space 11 within housing 4 which is also the length of groove 2. This space 11 serves to receive and to accommodate an elongated adjustment shaft 12 which is supported by a plurality of spaced roller rings 13, each of which carries adjustment shaft 12 in suitable roller bearings or the like, not specifically shown. Each of these spaced roller rings has a diameter that is less than spacing "a" between base plate 6 and upper wall 9. These roller rings 13 are rollably arranged on base plate 6 and the upper end wall 9 prevents them from moving up out of space 11.

A plurality of compression spring loaded tappets 14 are positioned in boreholes 16 formed in side wall 7 and each of these tappets 14 forms a stop at the left end of possible travel for each roller ring 13. A plurality of adjustment screws 17 are screwed through the opposing side wall 8 and each screw 17 forms a travel limiting means for a roller ring 13 in a direction to the right, as seen in the drawing FIGURE. Thus the rolling travel of roller rings 13 and hence of the adjustment shaft 12 carried by them, is determined by the adjustable spacing between spring biased tappets 14 and adjusting screws 17.

Adjusting shaft 12 carries an elongated bearing surface 18 between each of the spaced roller rings 13. As may be seen in the drawing FIGURE, each adjusting shaft bearing surface 18 is in the shape of an upwardly facing open slot. A lower, rounded bearing end 19.1 of a generally plate shaped connecting rod 19 is received in the adjusting shaft forming bearing surface 18 and forms a first knuckle type joint so that connecting rod 19 is pivotable with respect to adjusting shaft 12. An upper, generally rounded bearing end 19.2 of connecting rod 19 is received in a downwardly facing slotted lever arm bearing surface 21, and forms a second knuckle joint. This lever arm bearing surface 21 is positioned at a first or free end of a first lever arm 22 of a clamping bar 23. Clamping bar 23 also includes a second lever arm 24 which has a free end that is structured to form a clamping flap 24.1. First lever arm 22 and second lever arm 24, which cooperate to form clamping lever 23, are attached to each other at their inner ends and form an obtuse angle $\alpha$ of generally about 100°.

At the point of intersection of first and second lever arms 22 and 24 respectively, clamping lever 23 is provided with a generally rounded pressing bearing surface 23.1. This pressing bearing surface is pivotably received in an elongated bearing channel 20 that is formed at the outboard end of a bearing channel support arm 25 which is secured to a side wall 7 above upper end wall 6 and generally parallel thereto. This forms a third so-called knuckle joint. The location of bearing channel support arm 25 is further defined as being a distance "b" below a clamping flap supporting surface 26 which is formed at the upper end of side wall 7 of the housing 4.

Clamping flap 24.1 and clamping flap support surface 26 cooperate to form the clamping point for receipt and securement of the end 3.1 of printing plate 3 in accordance with the present invention. An operating lever 27 is rigidly and securely affixed to one end of adjusting shaft 12 and allows the shaft 12 to be rotated between clamped and unclamped positions in accordance with the present invention. In the open or unclamped position, the roller rings 13 rest against the adjustment screws 17 and the elongated bearing surface 18 on adjusting shaft 12 is generally in a three o'clock position.

Once a printing plate end 3.1 has been placed between clamping flap 24.1 and clamping flap supporting surface 26, lever 27 may be rotated in a counterclockwise direction, as seen in the sole drawing FIGURE, towards a lever stop bar 28. This rotation causes adjusting shaft bearing surface 18 to rotate to generally about a "one o'clock" position. This causes connecting rod or plate 19 to lift the free end of first lever arm 22 which, in turn, lowers the free end of second lever arm 24 to bring clamping flap 24.1 into clamping cooperation with clamping flap supporting surface 26 to clamp end 3.1 of printing plate 3.

Locking of the printing plate clamping assembly of the present invention is accomplished by further pivotal motion of adjusting shaft 12. This places adjusting arm bearing surface 18 and first lever arm bearing surface 21 in an aligned position with the axis of adjusting shaft 12. As the adjusting shaft bearing surface 18 continues to move to a "twelve o'clock" position, the adjustment shaft 12 not only rotates but also translates by being horizontally shifted along horizontal base plate 6 and in the direction of the compression spring loaded tappets 14. During this movement, the roller rings 13 roll along the base plate 6. A stop plate 28 is secured to side wall 8 and stops further movement of operating lever 27 so that adjustment shaft 12 will not be moved further. This placement of bearing surface in a "twelve o'clock" position effectively creates an over center lock for the clamping bar 23.

As was discussed above, the printing plate clamping assembly of the present invention is adaptable for use with printing plate ends 3.1 of differing thicknesses. This is accomplished merely be inserting the, for example, thicker plate end 3.1 between the clamping flap support surface 26. As lever 27 is rotated, clamping contact now will start when adjusting shaft bearing surface 18 is in a "two o'clock" as opposed to a "one o'clock" position. Thus adjusting shaft 12 begins its translational motion at that point. Clamping force remains the same and clamping effectiveness is not diminished regardless of the thickness of the printing plate end 3.1 being clamped by the printing plate clamping assembly of the present invention.

While a preferred embodiment of a printing plate clamping assembly in accordance with the present invention has been fully and completely set forth hereinabove, it will be understood that a number of changes in, for example, the type of printing plate used, the size of the plate cylinder, the number of spaced roller rings and the like could be made without departing from the true spirit and scope of the subject invention which is, accordingly to be limited only by the following claims.

What is claimed is:

1. A printing plate clamping assembly for clamping an end of a printing plate to a surface of a plate cylinder of a rotary printing machine, said printing plate clamping assembly being carried in a housing located in a groove in said plate cylinder and comprising:

clamping bar having first and second lever arms, a knuckle joint connected to said first one of said lower arms, said clamping bar being pivotable about an axis in said housing by said knuckle joint, and being lockable in a clamping position by movement of said knuckle joint to an overcenter position;

a rotatable adjustment shaft carried in said housing by roller rings and being supported in said housing for both rotational and translational movement relative to said housing, said adjustment shaft effecting movement of said knuckle joint to said over center position; and a compression spring loaded stop on said housing and contactable by said roller rings to permit said translational movement of said adjustment shaft during clamping of the printing plate end.

2. The printing plate clamping assembly of claim 1 wherein said adjustment shaft carries a bearing surface which receives a first end of a connecting rod, said adjustment shaft bearing surface and said connecting rod forming said knuckle joint.

3. The printing plate clamping assembly of claim 1 further comprising adjustable adjustment screws in a side wall of said housing and engageable with said roller rings.

4. The printing plate clamping assembly of claim 1 wherein said housing includes an upper end wall, said upper end wall holding said roller rings in said housing.

* * * * *